US005449543A

United States Patent [19]

Bach et al.

[11] Patent Number: 5,449,543

[45] Date of Patent: Sep. 12, 1995

[54] REINFORCED CELL MATERIAL

[75] Inventors: Gary M. Bach, Appleton, Wis.; Robert E. Crowe, Ontario, Canada

[73] Assignee: Reynolds Consumer Products Inc., Appleton, Wis.

[21] Appl. No.: 277,116

[22] Filed: Jul. 20, 1994

Related U.S. Application Data

[63] Continuation of Ser. No. 19,101, Feb. 18, 1993, abandoned.

[51] Int. Cl.[6] ..... B32B 3/12

[52] U.S. Cl. ..... 428/117; 52/793.11; 405/258; 428/184; 428/188

[58] Field of Search ..... 52/806, 807; 160/84.07; 405/258; 428/116, 117, 118, 184, 188

[56] References Cited

U.S. PATENT DOCUMENTS

| | | | |
|---|---|---|---|
| 3,990,247 | 11/1976 | Palmer | 428/116 X |
| 4,469,756 | 9/1984 | Jungwirth et al. | 428/364 X |
| 4,502,815 | 3/1985 | Scales et al. | 405/17 |
| 4,647,325 | 3/1987 | Bach | 156/73.1 |
| 4,648,224 | 3/1987 | Kitta et al. | 428/272 X |
| 4,675,060 | 6/1987 | Schnebly et al. | 156/65 |
| 4,717,283 | 1/1988 | Bach | 405/17 |
| 4,778,309 | 10/1988 | Bach et al. | 428/117 X |
| 4,856,939 | 8/1989 | Hilfiker | 405/284 |
| 4,965,097 | 10/1990 | Bach | 428/194 |
| 5,091,247 | 2/1992 | Willibey et al. | 428/255 |
| 5,336,544 | 8/1994 | Bach et al. | 405/258 X |

FOREIGN PATENT DOCUMENTS

| | | |
|---|---|---|
| 0239237 | 9/1987 | European Pat. Off. . |
| 0378309 | 7/1990 | European Pat. Off. . |
| 57-146835 | 9/1982 | Japan . |
| 2185769 | 7/1997 | United Kingdom . |

*Primary Examiner*—Henry F. Epstein
*Attorney, Agent, or Firm*—Alan T. McDonald

[57] ABSTRACT

A cell material structure for confinement of concrete and earth material, having a plurality of plastic strips bonded together on their faces in a side by side relationship at bonding areas which are staggered from strip to strip such that the plurality of strips may be stretched in a direction perpendicular to the faces of the strips to form a web of cells, the strips forming cell walls. At least one of the strips has an aperture through which a reinforcing member extends. Preferably, the reinforcing member is a tendon made of a polymer having a nominal breaking strength of from about 100 to about 2,500 lb.

15 Claims, 6 Drawing Sheets

REINFORCED CELL MATERIAL

This application is a continuation of application Ser. No. 08/019,101 filed Feb. 18, 1993; now abandoned.

FIELD OF THE INVENTION

The present invention relates to a reinforced cell material for confinement of concrete and earth materials. Specifically, the present invention relates to a cell web material which is reinforced with tendons to prevent unwanted displacement of the web material during installation and operation.

BACKGROUND OF THE INVENTION

Cellular confinement systems serve to increase the load bearing capacity, stability and erosion resistance of materials which are placed within the cells of the system. A commercially available system is Geoweb® plastic web soil confinement system, sold by Presto Products, Incorporated, P.O. Box 2399, Appleton, Wis. 54913. Geoweb® cells are made from high density polyethylene strips which are joined by ultrasonic seams on their faces in a side by side relationship at alternating spacings so that when the strips are stretched out in a direction perpendicular to the faces of the strips, the resulting web section is honeycomb-like in appearance, with sinusoidal or undulant shaped cells Geoweb® sections are light-weight and are shipped in their collapsed form for ease in handling and installation.

The web materials have been used extensively to provide road bases, subgrades or pavement systems. Structural foundations have been reinforced or stiffened with the web materials. Additionally, Geoweb® cells have been used to provide earth and liquid retention structures by stacking one web layer upon another, such as a stepped back design for hill slope retention. The Geoweb® cells also protect earth slopes, channels, revetments and hydraulic structures from surface erosion. Grass and other earth slope cover materials have been protected and stabilized through the use of the web cells. Geoweb® cells can be infilled with various earth materials such as sand, rounded rock, granular soils and aggregates, topsoil, vegetative materials and the like. Concrete and soil-cement or asphaltic-cement can also be used to infill the cells.

During installation and long-term operation of the web materials, the fill material and the webs may be displaced. Erosion below the web material may cause concrete infill to drop out of the cells. Concrete cannot be pre-cast in the web materials because the concrete fill would drop out of the cells as it was lifted and moved to the installation site. Applied forces such as hydraulic uplift and ice action may lift the web material or lift the fill material out of the cells. Translational movement of the webs may occur in channel lining applications, or when surface protection on steep slopes slides.

In an effort to overcome these problems, J hooks have been intermittently spaced along the face of some cell walls and driven into the ground to anchor the web material before the cells are infilled. The rounded portions of the J hooks extend over the tops of the cell walls to limit displacement of the web material. While this approach has limited displacement of the web materials in some applications, it has not been completely successful in preventing movement of the webs.

SUMMARY OF THE INVENTION

It is a primary object of the present invention to provide an improved cellular web material which is reinforced to minimize displacement of the web or fill material during installation and long-term operation. In this connection, a related object of this invention is to provide such an improved cellular material which resists hydraulic uplift, ice action, and translational movement.

Another important object of this invention is to provide a reinforced cellular web material which anchors poured-in-place concrete fill material within the cells to prevent displacement of the concrete from the cell and facilitate movement of the concrete infilled web material.

Yet another object of the invention is to provide a cellular web material reinforced by tendons having long term durability and optimum load-deformation characteristics and long-term creep performance.

The present invention provides a cell material structure for confinement of concrete and earth material, having a plurality of plastic strips bonded together on their faces in a side by side relationship at bonding areas which are staggered from strip to strip such that the plurality of strips may be stretched in a direction perpendicular to the faces of the strips to form a web of cells, the strips forming cell walls. At least one of the strips has an aperture through which a reinforcing member extends.

In a preferred embodiment, each of the cell walls has at least one aperture. The reinforcing member is a tendon made of any polymer having a nominal breaking strength of from about 100 to about 2,500 lb. which extends through the aperture of each of the cell walls. The tendon is preferably formed from a polymer which is enclosed in a polymer material which is acid and alkali resistant. The tendon is terminated on an end of the web by a loop of the tendon, or a washer and a knot of the tendon.

In another embodiment, the apertures of the cell walls are substantially coincident and are preferably positioned adjacent the bonding areas. Additionally, a length of the tendon is restrained from passing through the aperture of one of the cell walls into an adjacent cell of the web. A washer and a knot of the tendon provide the restraint.

Another aspect of the present invention is a method of installing a cell web having a plurality of cells by forming a set of substantially coincident apertures in cell walls of the cell web, guiding a tendon through the apertures, terminating the tendon at ends of the cell web, positioning the cell web on an earthen surface, anchoring the tendon to prevent movement of the cell web and filling the cells with concrete or earth material.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Figure 1:
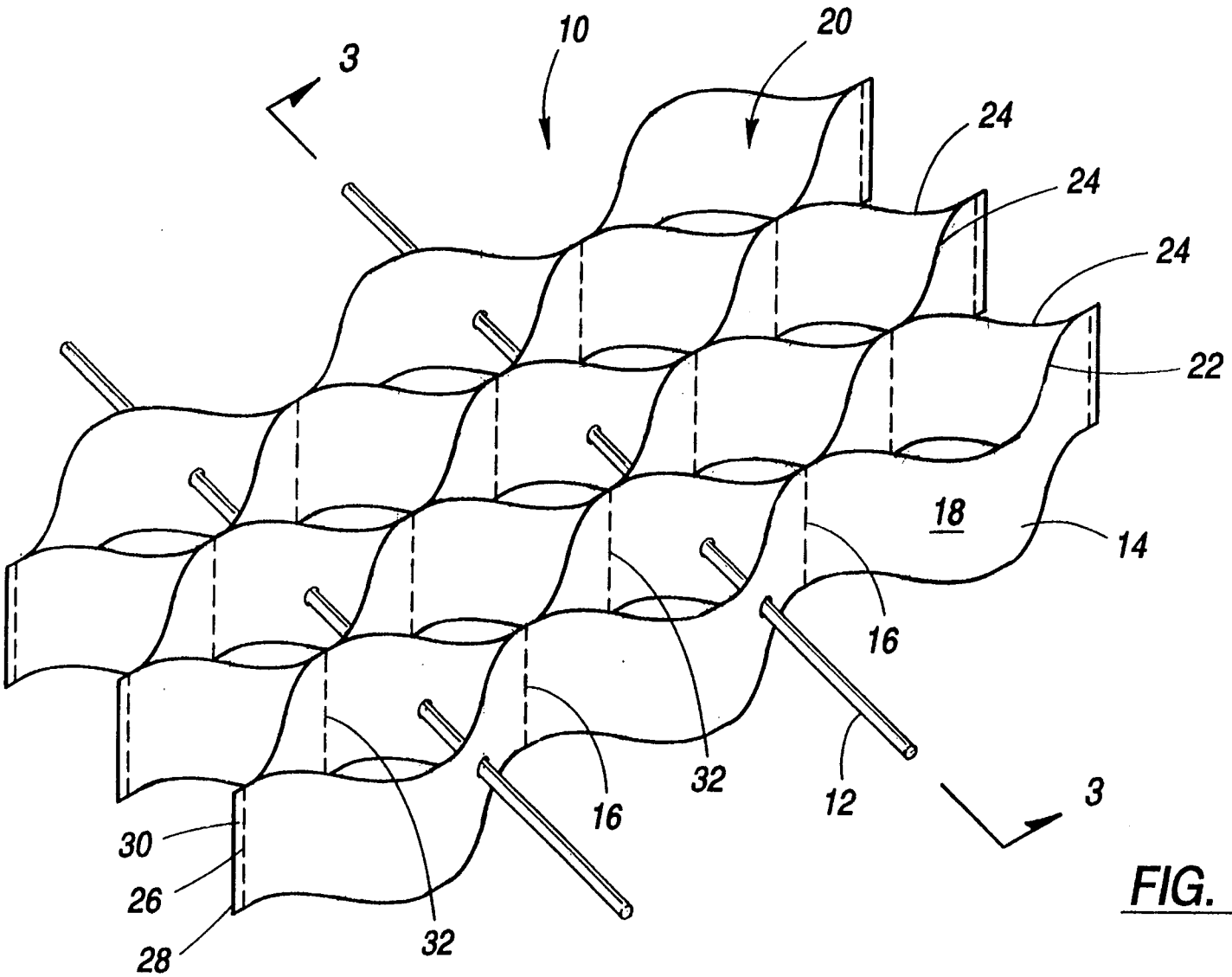
FIG. 1 is a partial perspective view of a single layer of the expanded reinforced cell material of the present invention.

Turning now to the drawings and referring specifically to FIG. 1, there is shown a cell material 10 reinforced by tendons 12. The cell material 10 has a plurality of strips of plastic 14 which are bonded together, one strip to the next at alternating and equally spaced bonding areas 16 to form cell walls 18 of individual cells 20. The bonding between strips may best be described by thinking of the strips 14 as being paired, starting with an outside strip 22 paired to an outermost inside strip 24, a pair of the next two inside strips 24, etc. Each such pair is bonded at a bonding area constituting an outside weld 26 adjacent the end 28 of each strip 14. A short tail 30 between the end 28 of strip 14 and the outside weld 26 is provided to stabilize segments of the strip 14 adjacent the outside weld 26. Each pair of strips is welded together at additional bonding areas 16, creating equal length strip segments between the outside welds 26. In addition to these welds, one strip 14 from each adjacent pair of strips 24 is also welded together at positions intermediate each of the welds in the pairs of strips, referred to hereafter as non-pair bonding areas 32. As a result, when the plurality of strips 14 are stretched in a direction perpendicular to the faces of the strips, the plastic strips bend in a sinusoidal manner and form a web of cells 20 in a repeating cell pattern. Each cell 20 of the cell web has a cell wall made from one strip and a cell wall made from a different strip.

Adjacent the bonding areas 16 or 32 are apertures 34 in the strips 14. Each tendon 12 extends through a set of apertures 34 which are substantially coincident. As used herein, the phrase "substantially coincident" means that the degree of overlap between adjacent apertures of the cell walls is greater than fifty percent, preferably greater than about 75 percent and, most preferably greater than about 90 percent. The tendons reinforce the cell web and improve the stability of web installations by acting as continuous, integral anchoring members which prevent unwanted displacement of the web.

Figure 2:
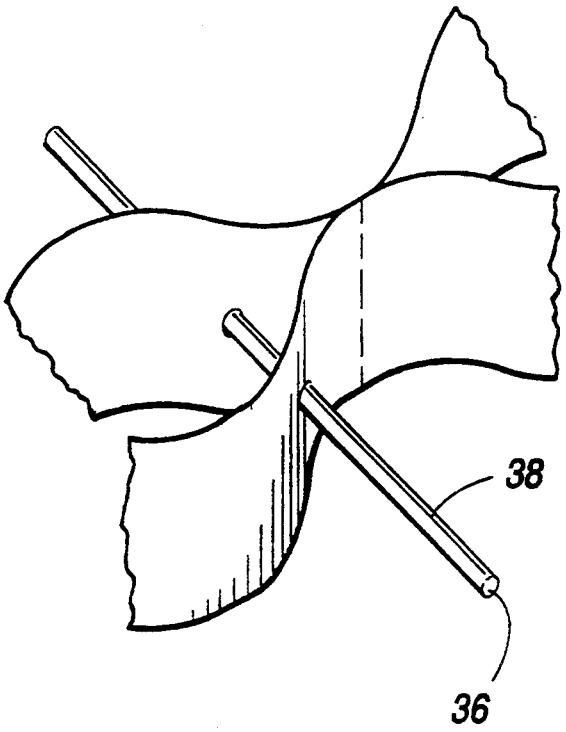
FIG. 2 is an enlarged perspective view of an expanded cell reinforced with a tendon.

As shown in FIG. 2, the tendon 12 is preferably rectangular or oval in cross section to provide a thin profile. A flexible tendon of rectangular or oval cross section is easily knotted to terminate the tendon at an end of the web or to connect adjoining sections of webs. Tendons having a flat profile also readily fold as the tendon is inserted through the apertures 34. In order to properly reinforce the cell web and anchor fill material placed within the cells, the tendon has a tensile strength of from about 100 to about 2,500 lb/in$^2$. Preferably, the tendon is formed from a polymer capable of providing such tensile strength as well as optimum load-deformation characteristics and long-term creep performance. Such polymers include polyester, polypropylene, polyethylene and the like.

In a preferred embodiment, the tendon is composed of a core material 36 surrounded by a sheath 38 which protects the core from a wide range of chemicals encountered in stabilization and environmental protection work. The core material 36 of the tendon is preferably any polymer having a nominal breaking strength of from about 100 to about 2,500 lb. A linear composite polymer core material is most preferred because it provides long-term durability comparable to that of the cell web. Linear composite tendons are commercially available from Delta Strapping Industries, Inc. of Charlotte, N.C. The sheath 38 may be composed of an acid and alkali resistant polymer or other acid and alkali resistant material to protect the tendon from deterioration when exposed to acidic or basic materials or environments, such as soil or limestone. A preferred tendon is made from continuous high-tenacity polyester filament bundles coated with a UV-stabilized high density polyethylene or polypropylene protective sheath. Such tendons have been manufactured commercially by the Conwed Company of Minneapolis, Minn.

Figure 3:
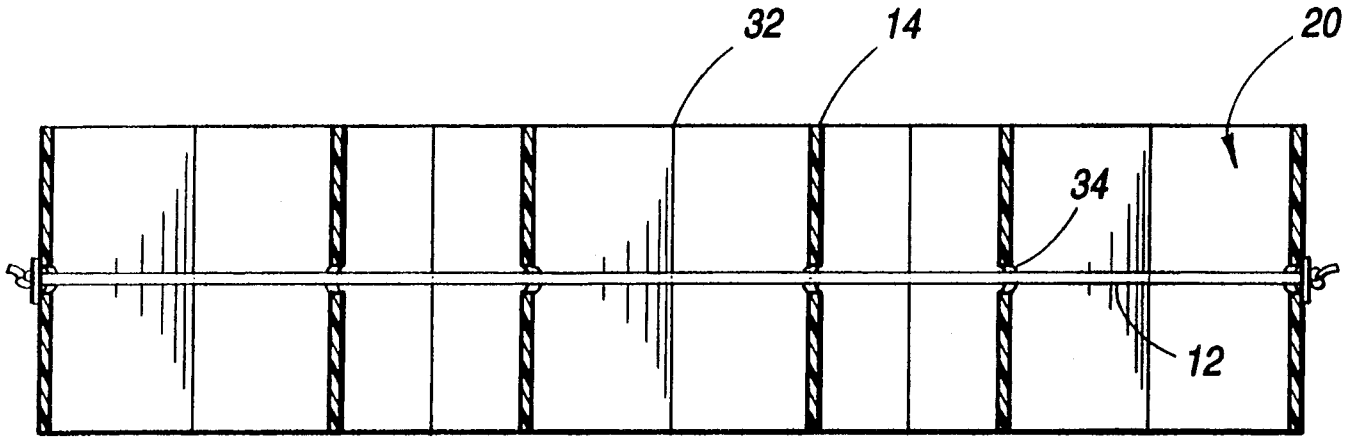
FIG. 3 is a partial cross-sectional view of the expanded cell material taken along line 3—3 of FIG. 1 and terminated by a washer and a double knot of the tendon.
Figure 4:
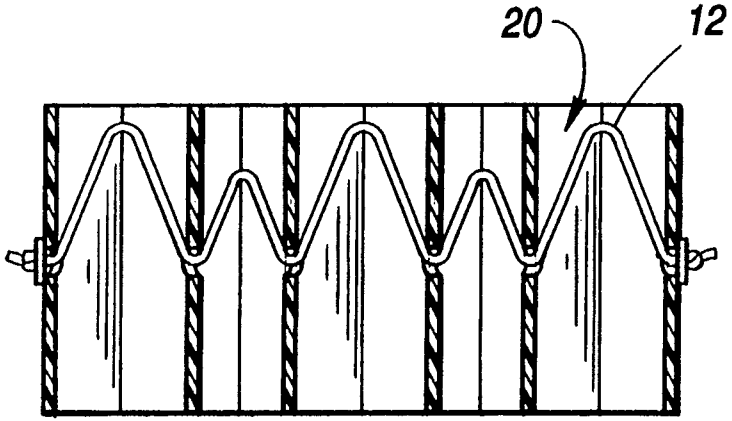
FIG. 4 is a partial cross-sectional view of the collapsed cell material taken along line 3—3 of FIG. 1 and terminated by a washer and a double knot of the tendon.

FIG. 3 illustrates a cross-section of an expanded web taken along the line 3—3 of FIG. 1 wherein the tendon 12 extends through the substantially coincident apertures 34 of each strip 14. FIG. 4 depicts the same cross section in collapsed form. As the web is collapsed, the length of tendon 12 within each cell 20 folds upwardly along its center such that the length of tendon assumes an inverted V-shaped form within the cell. The compactness of the collapsed cell webs is maintained due to the thin profile of the folded tendon. The tendons can be pre-installed during manufacture of the cell webs. Furthermore, the collapsed, reinforced cell webs are easily packaged, handled and shipped.

Figure 6:
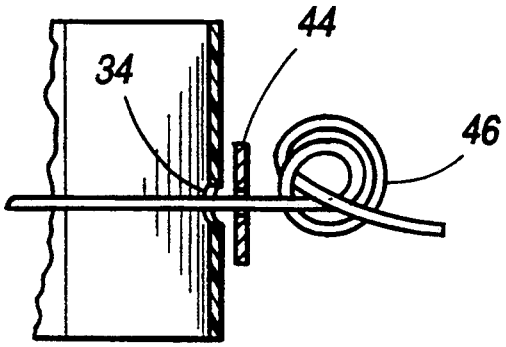
FIG. 6 is a sectional view of a cell reinforced with a polymer tendon and terminated by a washer and a double knot of the tendon.
Figure 5:
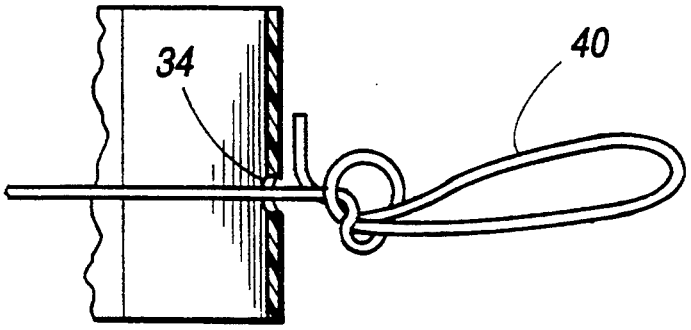
FIG. 5 is a sectional view of a cell reinforced with a polymer tendon and terminated by a loop of the tendon.
Figure 7:
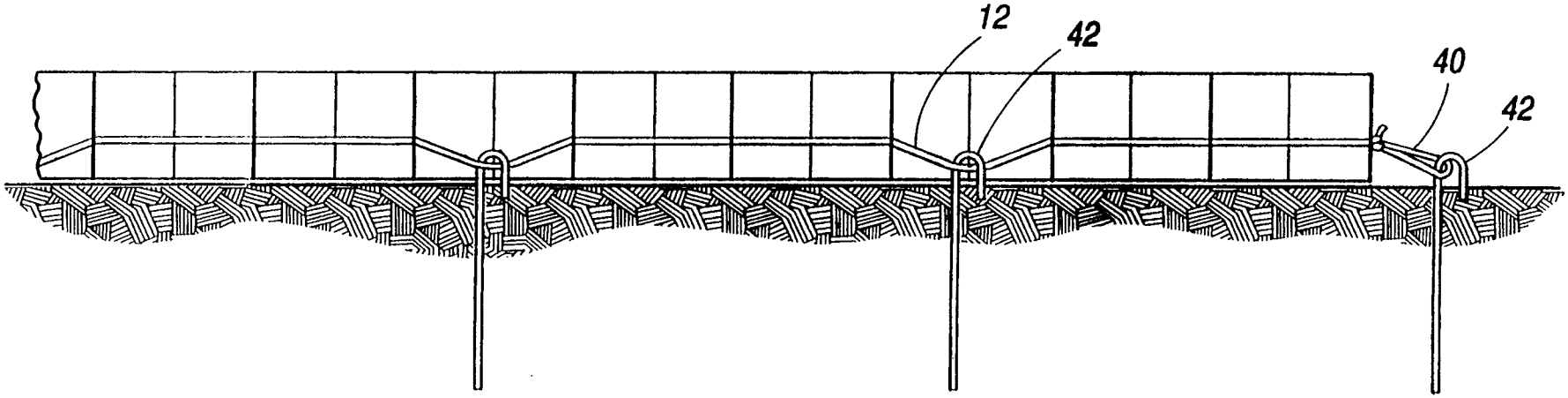
FIG. 7 is a cross-sectional view of an infilled reinforced cell material internally anchored by the reinforcing tendon.
Figure 8:
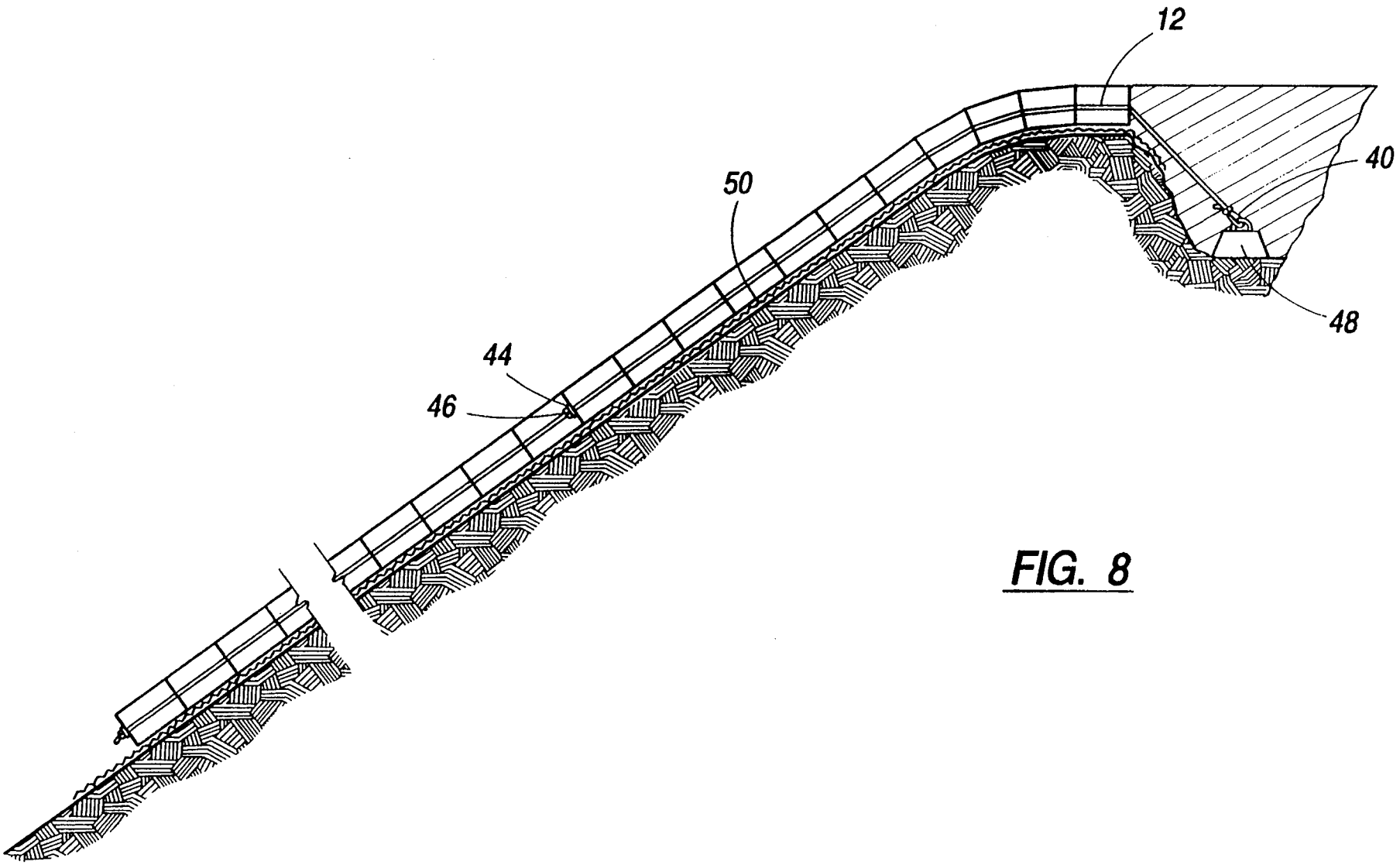
FIG. 8 is a cross-sectional view of an infilled reinforced cell material externally anchored by the reinforcing tendon.

A tendon is terminated at the ends of the cell web to maintain the tendon within the web. As illustrated in FIGS. 5 and 7, a preferred method of terminating a tendon 12 is by forming a loop 40 in the tendon after the tendon is guided through the aperture. In another preferred method, the tendon is terminated by a steel or polymer washer 44 which is threaded onto the tendon before a double knot 46 is formed such that the washer is positioned between the knot 46 and the aperture 34 as shown in FIGS. 6 and 8.

The number of tendons present within a web is dependent upon the application and the tensile strength of the tendon. For example, shoreline installations may require only one tendon attached to a cell on an end of the web to externally secure the web with an anchoring member. When tendons are used to join sections of the webs, the tails of the cells at the end of one web are positioned between the tails of the cells at the end of another web. A tendon is guided through a set of apertures in the tails of both interlocking webs to connect the sections of webs. Concrete-filled webs typically contain two tendons per cell to enable the webs to be moved, lifted and installed. Webs infilled with earth material often contain one tendon per cell. For most applications, cells of the web will include up to two tendons per cell. However, if tendons having lesser tensile strength are used, such as polypropylene strapping, additional tendons would be required to reinforce each cell.

In addition to reinforcing the cell webs, the tendons facilitate resistance to applied forces such as hydraulic uplift and ice action which tend to lift the cell webs. A web may be anchored to the ground at spaced intervals along the tendons to prevent lifting of the web. FIG. 7 illustrates a cross-section of an anchored expanded web taken along the line 3—3 of FIG. 1 wherein the tendon 12 extends through the substantially coincident apertures 34 of each strip. J-pins 42, or other earth anchors such as duckbill or auger anchors, are placed over the tendon 12 within cells 20 and are driven into the ground. The J-pins 42 internally anchor the tendon 12 to minimize lifting of the cell web away from the ground. Any number of the cells containing a tendon can be anchored. Preferably, the anchors are spaced at intervals between the ends of the web to resist applied forces along the entire length of the web. Anchoring is not required in some applications where applied forces are resisted by the passive resistance of the cell fill material acting on the top surface of the tendon spanning between the cells. Additionally, vegetative root mass which forms within the cells may envelope the tendons and impart a natural root anchorage to the system. The web illustrated in FIG. 7 is also externally anchored by a J-pin 42 or other earth anchor which is placed within the loop 40 which terminates the tendon. The loop may also be connected to a tendon of an adjoining web if desired.

Anchoring the tendons to earth anchors at the upper end of each web resists forces which cause translational movement of the cell webs, such as tractive forces experienced in channel lining applications, or sliding of surface protection on steep slopes. FIG. 8 illustrates a cell web which is anchored by a passive restraint anchor at the crest of the slope on which the web rests. The tendon 12 is terminated with a loop 40 which is attached to the deadman anchor 48 to minimize translational movement of the web. The web is positioned above a geotextile or geomembrane liner 50, particularly when the fill material is dissimilar to the subgrade. When a reinforced cell web is installed on a sloped surface, restraints may be formed along a length of the tendon to support the cells after they are infilled. A preferred restraint is formed by guiding the tendon through an aperture, threading a washer 44 onto the tendon, and forming a double knot 46 in the tendon such that the washer is positioned between the knot and the aperture as illustrated in FIG. 8.

When the cell webs are used in multiple layers as earth retaining structures, the ends of the tendons of each cell web layer can be anchored to the backfill soil to resist translational sliding and overturning due to active earth pressures. The preferred method of constructing such earth retaining structures is to anchor guide posts into the ground at the corner positions where the structure is to be built. The base layer web is then stretched out and the corner cells are slid down over the posts. A suitable fill material is filled into the cells of the base layer web and compacted if desired. Subsequent web layers are then stretched out and slid down over the posts, infilled and compacted until the structure is of the desired height.

Figure 9:
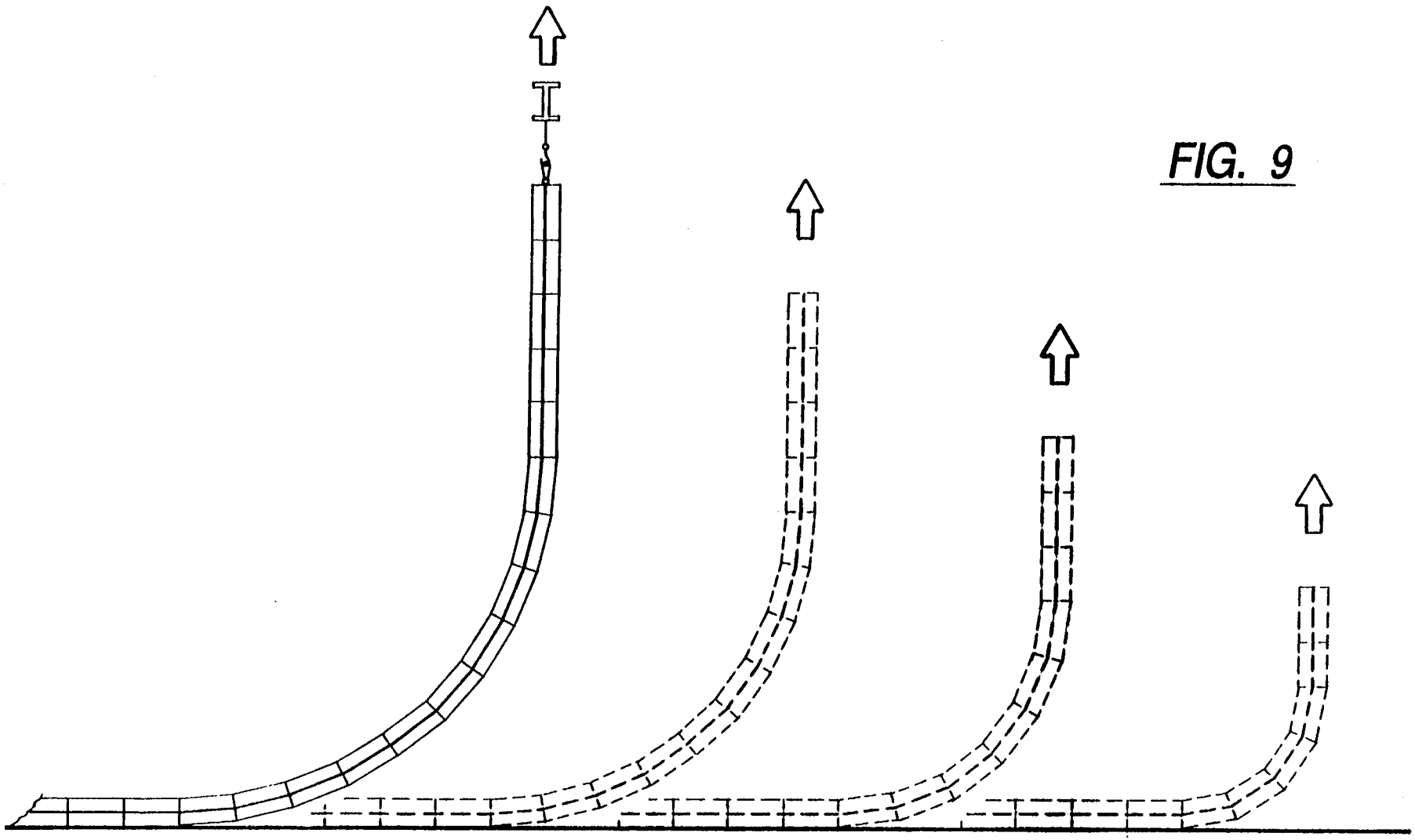
FIG. 9 is a cross-sectional view of a concrete infilled reinforced cell material being lifted for installation.

When concrete infill is required, concrete can be pre-cast in the reinforced cell webs of the present invention before installation of the web because the tendons anchor the concrete within the cells. The concrete encases the tendons within the cells such that the concrete is cast around the tendons. The tendons anchor the concrete within the cells so the concrete is not displaced when the cell web is lifted. Furthermore, the tendons remain flexible such that pre-cast sections of concrete-filled cell webs can be moved, lifted and installed as shown in FIG. 9. Concrete-filled cell webs exhibit maximum flexibility when the tendons are positioned about the midpoint of the face of a strip (i.e., at about half the width of the cell wall). In a preferred embodiment, each of the cell walls has two apertures such that the apertures of each of the cell walls of a cell are substantially coincident. Tendons extend through each set of substantially coincident apertures and are terminated at the ends of the web. The pre-cast sections are lifted by the terminated ends of the tendons extending from the web and are moved for installation. Concrete-filled cell webs are easily installed below water providing excellent protection for shorelines, revetments, spillways, chutes and the like. The webs conform to subgrade movement during underwater operation to prevent piping and undermining. Conventional boat ramps and other underwater structures can be replaced by the pre-cast sections. The pre-cast sections can also be used on land as road base structures.

The cell webs can be installed by manually expanding the web in a direction perpendicular to the faces of the strips of the web and infilling the cells with concrete or earth material. When the reinforced cell webs are infilled with earth material, the webs can also be installed through the use of an installation frame as described in U.S. Pat. No. 4,717,283, issued Jan. 5, 1988 to Gary Bach and incorporated herein by reference. The cell web is secured to the installation frame to maintain the web in expanded form. The frame is rotated such that the web rests on the installation surface. Before the frame is removed, the tendons may be internally or externally anchored to the surface as shown in FIGS. 7 and 8. The cells are then infilled with earth material to maintain the cell web in its expanded configuration. The earth materials such as sand, rounded rock, granular soils and aggregates, topsoil, vegetative materials and the like, exert force on the top surface of the tendon spanning between the cells to anchor the web.

The cell material is preferably made from sheet extruded polyethylene of 50 mil thickness. Carbon black may be included in the plastic to help prevent ultraviolet degradation of the web material when exposed to sunlight. The faces of the plastic strips of cell material may also have textured surfaces as disclosed in U.S. Pat. No. 4,965,097, issued Oct. 23, 1990 to Gary Bach and incorporated herein by reference. The cell webs may also include notches which allow adjoining layers of cell webs to overlap along their edges to improve the stackability of the webs in forming earth retaining structures as described in U.S. Pat. No. 4,778,309, issued Oct. 18, 1988 to Bach et al.

The plastic strips may be bonded together by a number of methods known in the art. The preferred method of ultrasonic welding is accomplished using the process and apparatus disclosed in U.S. Pat. No. 4,647,325, issued Mar. 3, 1987 to Gary Bach and incorporated herein by reference. The bond is formed as groups of welding tips simultaneously contact the strips 14 to form a weld substantially traversing the entire width of the strips 14.

The apertures 34 may be formed in the strips 14 by a number of methods known in the art either before or after the strips are bonded together. Preferably, the apertures are formed by drilling through a collapsed cell web to form a set of substantially coincident apertures through the web. A suitable length of tendon is then guided through each aperture, and may be restrained within the cell web as discussed above in reference to FIG. 8. The tendon is terminated at the ends of the web with either a loop of tendon or a washer and a double knot as shown in FIGS. 5–8. As the cell web is then fully expanded, the tendon is positioned within the cells and is folded vertically between adjacent cell walls as the cell web is re-collapsed. The reinforced cell material is then palletized and shipped for installation. Alternatively, the tendons may be guided through the apertures at the installation site.

The apertures are preferably positioned at about the midpoint of the width of the plastic strips when infilled with concrete resulting in minimal tension on the tendons. When infilled with earth materials, the apertures are preferably positioned below the midpoint of the width of the plastic strip so that more weight is placed on the tendon to anchor the web. The apertures may be positioned anywhere along the length of the cell walls, but it is preferred that the apertures are not formed in the bonding areas.

The web materials may be manufactured to result in webs of any dimension, but are typically three to eight feet wide and eight to twenty feet in length when stretched out for use. In the preferred embodiment, each plastic strip 14 is eight inches wide. The bonding areas 16 are about thirteen inches apart on each strip, as are the non-pair bonding areas 32. Each cell wall 18 comprises a section of the plastic strip about thirteen inches in length, between adjacent bonding areas 16 or non-pair bonding areas 32. The tail 30 is about one inch in length. The tendon 12 is about one-quarter to three-quarter inch wide and the apertures 34 have a diameter slightly greater than the width of the tendon.

We claim:

1. In a cell material structure for confinement of concrete and earth material, comprising:

a plurality of plastic strips bonded together on their faces in a side by side relationship at bonding areas which are staggered from strip to strip such that the plurality of strips may be stretched in a direction perpendicular to the faces of the strips to form a unitary web of cells, the strips forming cell walls, the improvement wherein adjacent strips of the plurality of strips have apertures, and flexible reinforcing means extending through said apertures of said adjacent strips, said flexible reinforcing means being capable of aligning with said unitary web when said unitary web is positioned on a contoured surface.

2. The cell material structure of claim 1 wherein the reinforcing means is a tendon comprised of a material having a nominal breaking strength of from about 100 to about 2,500 lb.

3. The cell material structure of claim 2 wherein an outer surface of the tendon is enclosed by an acid and alkali resistant material.

4. The cell material structure of claim 1 further including means for terminating the reinforcing means on an end of the web.

5. The cell material structure of claim 4 wherein the reinforcing means is a tendon and the terminating means is a loop of the tendon, or a washer and a knot of the tendon.

6. A cell material structure for confinement of concrete and earth material, comprising:

a plurality of plastic strips bonded together on their faces in a side by side relationship at bonding areas which are staggered from strip to strip such that the plurality of strips may be stretched in a direction perpendicular to the faces of the strips to form a unitary web of cells, the strips forming cell walls, the improvement wherein each of the cell walls has an aperture, and wherein said cell material structure includes flexible means for reinforcing the unitary web, the reinforcing means extending through the aperture of each of the cell walls, said flexible reinforcing means being capable of aligning with said unitary web when said unitary web is positioned on a contoured surface.

7. The cell material structure of claim 6 wherein the reinforcing means is a tendon comprised of a material having a nominal breaking strength of from about 100 to about 2,500 lb.

8. The cell material structure of claim 7 wherein the material is a polymer.

9. The cell material structure of claim 7 wherein an outer surface of the tendon is enclosed by an acid and alkali resistant material.

10. The cell material structure of claim 9 wherein the acid and alkali resistant material is a polymer.

11. The cell material structure of claim 6 further including means for terminating the reinforcing means on an end of the web.

12. The cell material structure of claim 11 wherein the reinforcing means is a tendon and the terminating means is a loop of the tendon, or a washer and a knot of the tendon.

13. The cell material structure of claim 6 wherein the apertures are positioned adjacent the bonding areas, the apertures being substantially coincident.

14. The cell material structure of claim 6 wherein the apertures are positioned below a midpoint of the faces of the strips.

15. The cell material structure of claim 6 wherein the apertures are positioned about a midpoint of the faces of the strips.

* * * * *